United States Patent [19]

Faehling et al.

[11] Patent Number: 4,471,755

[45] Date of Patent: Sep. 18, 1984

[54] FIREPLACE STRUCTURE

[75] Inventors: Francis L. Faehling; Stanley O. Peterson; Thomas F. Billmeyer, all of Wisconsin Rapids, Wis.

[73] Assignee: Preway Inc., Wisconsin Rapids, Wis.

[21] Appl. No.: 965,066

[22] Filed: Nov. 30, 1978

[51] Int. Cl.[3] ..... F24B 7/00

[52] U.S. Cl. ..... 126/121; 126/112; 126/285 R; 126/288

[58] Field of Search ..... 426/121, 112, 193, 285 R, 426/288, 286, 295, 292; 98/119, 48; 236/1 G; 110/157, 163; 237/46, 47, 48

[56] References Cited

U.S. PATENT DOCUMENTS

| | | | |
|---|---|---|---|
| 549,547 | 11/1895 | Tercy | 98/48 X |
| 1,272,064 | 7/1918 | Lezius | 98/119 |
| 1,307,950 | 6/1919 | Anderberg | 126/45 |
| 1,346,883 | 7/1920 | Frederick | 98/48 |
| 1,668,911 | 5/1928 | Jowett | 126/292 |
| 2,620,984 | 12/1952 | Larsen | 126/285 R X |
| 2,863,443 | 12/1958 | Hoffman | 126/121 |
| 3,111,301 | 11/1963 | Ruegsegger | 136/45 X |
| 3,180,332 | 4/1965 | Grushkin | 126/121 |
| 4,004,731 | 1/1977 | Zung | 126/121 X |
| 4,184,475 | 1/1980 | Faehling et al. | 126/121 |

FOREIGN PATENT DOCUMENTS

| | | | |
|---|---|---|---|
| 257777 | 9/1912 | Fed. Rep. of Germany | 98/119 |

*Primary Examiner*—Larry Jones

*Attorney, Agent, or Firm*—Wood, Dalton, Phillips, Mason & Rowe

[57] ABSTRACT

A fireplace having one or more conduits for directing outside combustion air into the firebox with a movable member adjacent a conduit outlet for normally closing said conduit and having either open or closed positions dependent upon the existence of a pressure difference across said member. A pressure difference caused by a fire in the firebox results in a higher pressure on the side of the member opposite the firebox to cause the member to move to open position. Operating structure is provided for positively closing the member and with the operating structure being operable from the front of the fireplace.

12 Claims, 7 Drawing Figures

10
11
23
32
31
41
2.
32
40
30
75
25
20
21a
21
71
16
15
76
73
22
70
72
2.

3
60
42a
42
44
45
43
40
85
75
70
72
3.

51
81
47
85
40
50
80
30
46
21a
75
72
71

47
60
81
51
44
42
43
85
40
80
50
46
21a

FIREPLACE STRUCTURE

BACKGROUND OF THE INVENTION

This invention pertains to fireplaces, such as those disclosed in application Ser. No. 815,066, filed July 12, 1977, wherein the fireplace is constructed for delivery of outside air into the firebox to facilitate combustion. The use of outside air for combustion is optional, but is desirable and is sometimes required when door means are associated with the fireplace for closing the front opening thereof.

It is known in the art to have fireplaces with conduits or passage means for directing outside air to the firebox for combustion. In such a fireplace, there can be a flow of outside air to the firebox, whether or not the fireplace is in use. When the fireplace is not being used, this connection of the conduit to the exterior can cause cold drafts which are objectionable to persons occupying the area of the room adjacent to the fireplace. The prior application mentioned above discloses a fireplace with a pair of conduits or passage means for directing combustion air into the firebox and with movable members or dampers associated one with each of the conduits and which may be moved between open or closed positions by means of operating structure operable from the front of the fireplace. The movable members do not operate automatically.

SUMMARY OF THE INVENTION

A primary feature of the invention disclosed herein is to provide a fireplace having a conduit for supplying external outside air to the firebox for use in combustion and with automatically operable means for controlling the open and closed condition of said conduit.

More particularly, the fireplace has a movable member or damper positioned adjacent the outlet of the aforesaid combustion air conduit and with said member being mounted to have a normal inactive position which closes the conduit outlet and constructed and arranged for automatic opening movement in response to the existence of a fire in the firebox of the fireplace. The member automatically closes as the fire dies out.

In carrying out the foregoing features of the invention the movable member is in the form of a plate or disc mounted adjacent the outlet of the conduit for pivotal movement about a horizontal axis and with the surface areas of the disc being related to the pivot mounting thereof whereby the existence of a fire in the firebox results in a reduced pressure on the face of the disc exposed to the firebox and a higher pressure at the opposite face thereof whereby the resulting pressure difference causes opening movement of the disc. Additionally, the disc has weight means associated therewith which helps to further open the member after initial opening thereof and also functions to help maintain the member in fully-closed position.

Another feature of the invention is to provide operating structure operable from the front of the fireplace for positively maintaining the movable members in closed position and also operable to free the members for movement to an open position in response to a pressure difference.

DESCRIPTION OF THE PREFERRED EMBODIMENTS

Figures 1, 2, 3, 4:
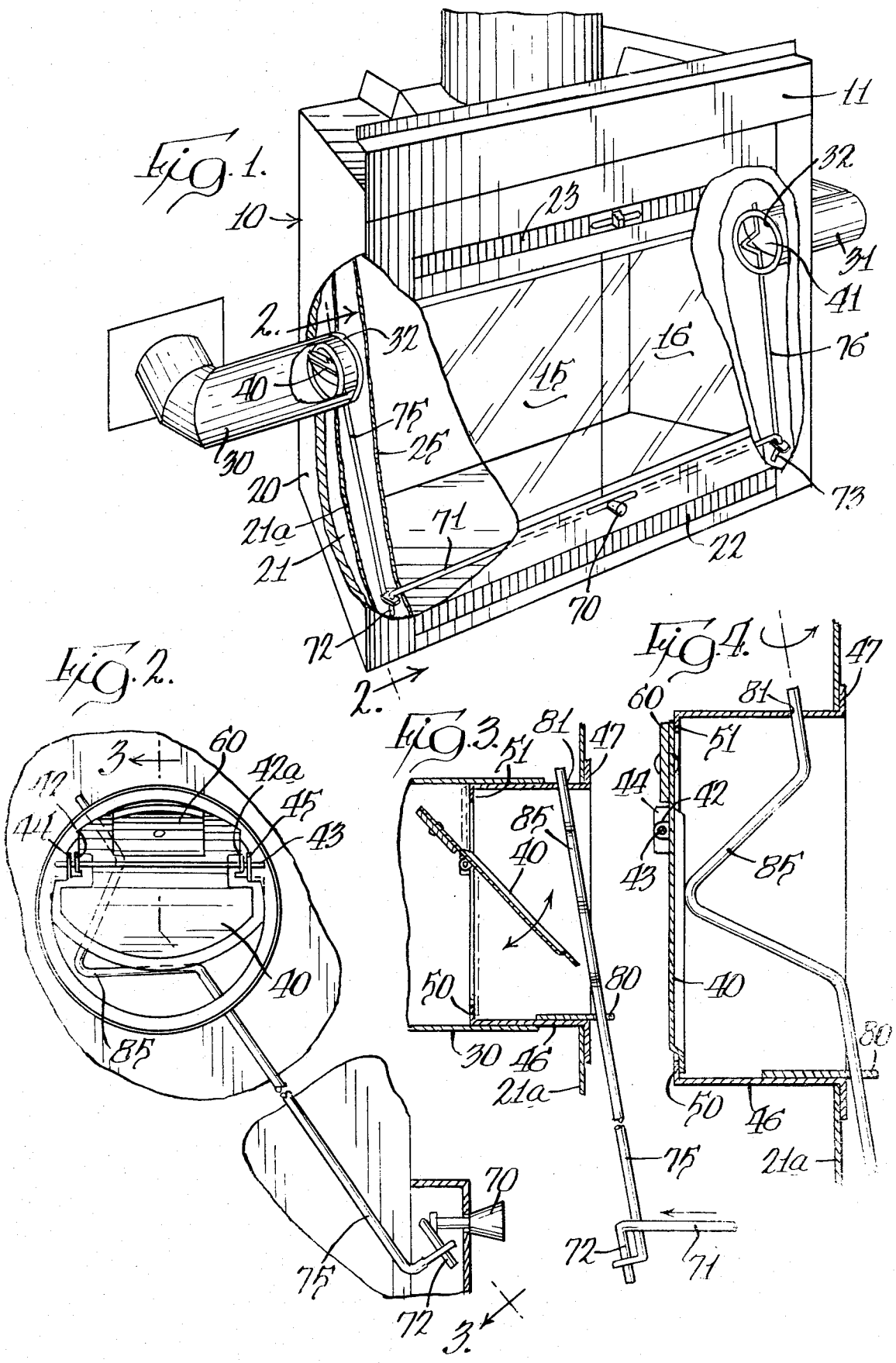
FIG. 1 is a front perspective view of the fireplace showing a pair of combustion air conduits associated therewith and with parts broken away.
FIG. 2 is a fragmentary sectional view, on an enlarged scale, taken generally along the line 2—2 in FIG. 1.
FIG. 3 is a generally vertical section, taken generally along the line 3—3 in FIG. 2.
FIG. 4 is a fragmentary view of the structure shown in FIG. 3 on a further enlarged scale and showing a part of the operating structure holding the movable member in closed position.

The fireplace is shown generally in FIG. 1 and has a casing, indicated generally at 10, of a construction well known in the art and having a front wall 11 which may be closed, if desired, by a pair of transparent doors 15 and 16. These doors may be mounted for hinged pivotal movement or for sliding movement and, if for sliding movement, each of the doors may be of multiple sections arranged on spaced tracks for movement to an open, overlapped relation.

The casing 10 has a multi-wall construction, with an external wall 20 and an intermediate wall 21, with insulation therebetween. The intermediate wall 21 and a firebox wall **21*a* define a circulating air space therebetween whereby room air may enter through a lower grill 22 and flow between the walls for return to the room through an upper grill 23. The firebox wall 21*a* is one of several walls including an opposite side wall, a rear wall, a bottom and top which define a firebox. Each of the firebox side walls has an adjacent side panel 25** forming a heat shield member and guiding the flow of external combustion air to the lower side of the firebox.

Passage means for directing external air to the firebox for combustion includes a pair of tubular conduits 30 and 31 which can extend to an outside wall of the house or other structure for receiving outside air and each having an outlet opening 32 in the associated firebox side wall.

The foregoing structure is that as generally shown in said prior application, Ser. No. 815,066.

With the construction described, it will be seen that outside air may flow through the conduits 30 and 31 and out of the opposed outlets 32 at opposite sides of the firebox for flow downwardly between the firebox walls and the side panels 25 for delivery to the lower part of the firebox to assist in combustion. The fireplace may have a mesh screen positioned in the front opening or the door means 15 and 16 previously referred to. With the mesh screen, there is an extreme draft condition, with conduits 30 and 31 being open to the outside and there can also be a draft condition even with the door means because of the cold outside air keeping the fireplace walls cold and with the limited circulation of air through the grills 22 and 23 and the contact of the air with the cold walls of the firebox.

The invention herein relates to an improved structure for controlling the opening and closing of the conduits for external air with the conduits normally being closed when the fireplace is not in use and being automatically opened when the fireplace is in use, without requiring manual operation of structure for opening and closing the conduits.

The improved structure resides in the use of an automatically-operable member or damper positioned one adjacent each of the conduit outlets, with a member 40 being associated with the conduit 30 and a member 41 with the conduit 31. Each of these members is of the same construction and the member 40 and associated structure is shown particularly in FIGS. 2 to 4. The member 40 is generally similar to a barometric draft regulator, as used in association with a furnace stack or chimney for controlling the supply of surrounding air to the stack in order to provide a proper draft in the stack. The member 40 is in the form of a plate or disc having a pair of outwardly-extending ears 42 and 42*a* for receiving a pivot pin 43 which extends through a pair of ears 44 and 45 extending from collar member 46 fitted within an end of the conduit 30. The collar has a radial flange 47 which engages against the internal face of the firebox wall 21*a*. The opposite end of the collar 46 has a pair of flanges with a lower generally semicircular upright flange 50 and an upper substantially semicircular downwardly-extending flange 51. As shown in broken line in FIG. 3, these flanges provide abutting surfaces for the member 40 when in closed position.

As the member 40 moves to open position, as shown in full line in FIG. 3, the member pivots about the pivot pin 43 away from said flanges. With the member in closed position, as shown in broken line in FIG. 3 and full line in FIG. 4, the member is substantially in balance about the horizontal axis defined by the pivot pin 43 and with a greater surface area of the member being beneath the pivot than thereabove. The member is normally held in closed position by its weight and by a weight 60 attached to the upper part thereof and located relative to the pivot 43 whereby the effectiveness of the weight is acting in a direction to pivot the member clockwise, as viewed in FIGS. 3 and 4 and hold the member against the flanges 50 and 51.

With the greater area of the member 40 being beneath the pivot, this area, at both faces of the member, is responsive to the pressure acting thereon and when there is a pressure difference with the higher pressure on the left-hand side thereof, as viewed in FIG. 4, the member is caused to pivot in a counterclockwise direction to the open position shown in FIGS. 2 and 3. This pressure difference results from the existence of a fire in the firebox which creates a draft within the firebox and a reduced pressure on the right-hand face of the member, as viewed in FIG. 4, as compared to the pressure of atmospheric air within the conduit 30.

As a fire in the firebox dies out, the temperature within the outlet stack or flue 90 from the fireplace is down, with the result that the weight of the member beneath the pivot 43 is sufficient to return the member to closed position and the weight 60 helps to maintain the member in fully-closed position. This prevents flow of warm air out of conduit 30.

Although not essential to utilization of the fireplace, the members 40 and 41 have operating structure associated therewith for positively maintaining the members in closed position. This operating structure includes a manually-operable knob 70 at the front of the fireplace which is connected to a rod 71 extending laterally beneath the front opening of the fireplace to opposite sides thereof. This rod has downturned ends 72 and 73 which connect into a pair of upwardly and rearwardly inclined rods 75 and 76, respectively. Each of these rods is similarly mounted and, as shown for the rod 75, the rod rotatably extends through a plate 80 secured, as by welding, to the inner face of the collar 46 and also through an opening 81 in the wall of the collar. Intermediate these rotation mountings of the rod is a rod part 85 having a bent shape whereby rotation of the rod 75 will move the rod part 85 between a withdrawn position, shown in FIG. 3, and a member-locking position, shown in FIG. 4. When it is desired to lock the member 40 in closed position, the rod part 85 is in the position shown in FIG. 3 and rotation of the rod 75 will move the rod part to the position shown in FIG. 4. In the event the movable member 40 is open during this action, the rod part is located as to move toward the member 40 and engage the upper surface thereof, and progressively move the member 40 to the closed position, shown in FIG. 4. The construction of the rod 76 and mounting thereof, is the same as that described for the rod 75 and with the rod part 85 being suitably shaped to provide the same action as described in connection with the rod part 85 of the rod 75.

Figure 5:
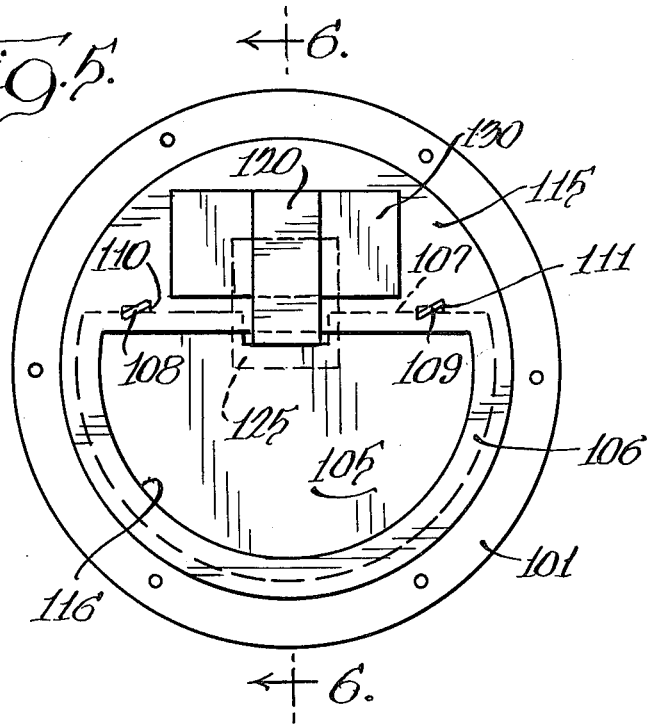
FIG. 5 is an elevational view of a preferred embodiment of a damper unit usable in the fireplace.
Figure 6:
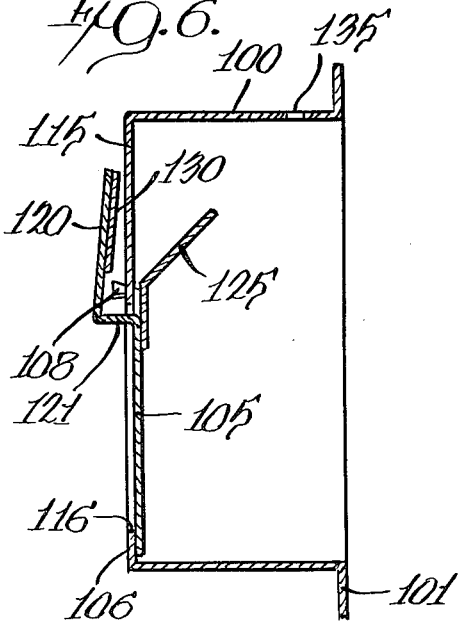
FIG. 6 is a vertical section, taken generally along the line 6—6 in FIG. 5 showing the plate member in closed position.
Figure 7:
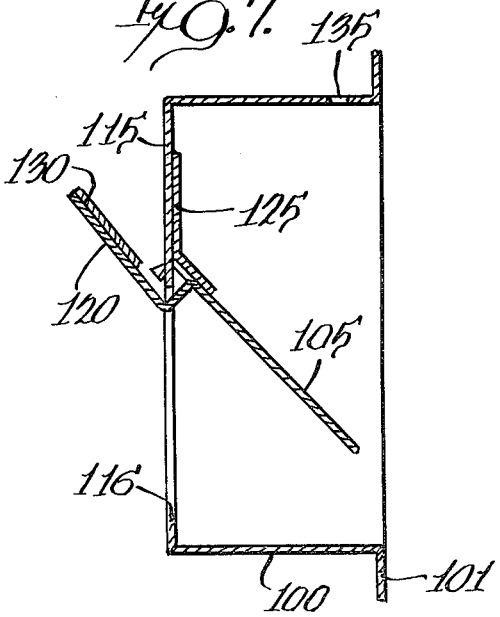
FIG. 7 is a view similar to FIG. 6 showing t he plate member in open position.

A preferred embodiment of automatically-operable member or damper usable in the fireplace is shown in FIGS. 5 to 7. A pair of these structures can be embodied in the fireplace shown in FIG. 1 and with the pair of structures having a pair of operating rods 75 and 76 associated therewith, as shown in the embodiment of FIGS. 1 to 4.

The preferred embodiment is of a more economical construction than that shown in the first embodiment, but has a lesser cross-sectional area for flow of combustion air therethrough. This lesser cross-sectional area is adequate to provide combustion air to the fireplace. However when a greater total flow may be required and when there is not a sufficient number of combustion airflow conduits, such as conduits 30 and 31, then the damper shown in FIGS. 1 to 4 can be utilized.

In the construction of FIGS. 5 to 7, a generally tubular collar member 100 has a radial flange 101 to engage the internal face of the firebox wall 21*a*. A damper member 105 in the form of a plate or disc has a generally semi-circular shape and is shown in closed position in FIGS. 5 and 6. The damper member 105 has its arcuate periphery positioned to engage against a flange 106 formed on the collar member 100 when the damper member is closed. The upper edge of the damper member 105, as viewed in FIGS. 5 and 6, defines a generally straight edge extending between opposite arcuate ends of the member and is shown in broken line at 107 in FIG. 5. The damper member is hinged to the collar member by a pair of tabs 108 and 109 which are formed to extend normal to the plane of the damper member and to extend through a pair of openings 110 and 111, respectively, in a transverse wall 115 of the collar member 100. The transverse wall 115 has generally semi-circular opening defined by an edge 116 which forms the combustion air flow passage when the damper member is open. The tabs 108 and 109 are in an untwisted condition upon initial assembly and are extended through the opening 110 and 111 and, thereafter, a slight twist is imparted to the free ends thereof to result in the shape as shown in the drawings whereby the damper member is pivotally retained relative to the collar member.

Also integral with the damper member is an offset, upwardly-extending arm 120 having a lower connecting end 121 which enables the arm 120 to lie to a side of the transverse wall 115 opposite the side at which the body of the damper member is positioned. A second arm 125 is fastened to a face of the damper member 105 and has an angularly-extending end which forms a stop to limit opening movement of the damper member, as shown in FIG. 7.

Weight means, similar to the weight 60 of the embodiment shown in FIGS. 1 to 4 acts to hold the damper member in closed position when it is closed and aids in opening movement of the damper member as it opens. This weight means includes a weight 130 secured to the arm 120 which is integral with the damper member and also the stop arm 125.

The relation of the parts when the damper is closed is shown in FIG. 6 whereby engagement of the damper member 105 against the flange 106 of the collar member closes the combustion airflow passage through the transverse wall 115. Under conditions similar to those described in connection with the embodiment of FIGS. 1 to 4, the damper member can move to an open position, as shown in FIG. 7 and also return to a closed position.

As mentioned previously, the damper member can be positively moved to closed position and held closed, as by use of a rod 75 as shown in the embodiment of FIGS. 1 to 4, and the collar member 100 has an opening 135 in the wall thereof to receive such rod, but with the rod being omitted from the Figures.

Although the automatically-operated structure is shown and described in connection with a pair of conduits entering the side walls of the firebox, it will be obvious that the structure may be associated with one or more conduits for providing external air to the fireplace for combustion and with the conduit outlet entering into the firebox at any desired location.

With the movable member or damper, it will be seen that the conduit is effectively opened on demand in response to a fire in the fireplace and closed when the fireplace is not in operation. The structure prevents reverse flow through the conduits 30 and 31 when the fireplace is in operation with the fireplace doors open and functions to keep out cold, external air when the fireplace is not in operation.

We claim:

1. In a fireplace structure having a firebox, an outlet flue, and a conduit having an air inlet external of said fireplacee structure and an outlet positioned for delivery of combustion air to said firebox remotely from said outlet flue, the improvement comprising means for preventing warm air from exteriorly adjacent the firebox from passing inwardly through the firebox and outwardly through said conduit and cold air from said air inlet from passing inwardly through said conduit as when a fire is not present in the firebox, said means including a movable member normally closing said conduit and openable only in response to a pressure difference across said member wherein the lower pressure is on the firebox side.

2. A fireplace structure as defined in caim 1 wherein said movable member is positioned against a stop when normally closing said conduit, and said member being positioned and arranged to remain against said stop in the absence of said pressure difference.

3. A fireplace structure as defined in claim 1 wherein said movable member is a disc which substantially blocks said conduit when in a closed position and said means further includes a pivot mounting for the disc whereby the disc can pivot about a generally horizontal axis in opening thereof, the weight of the disc being related to the pivot mounting whereby the disc is normally closed and said disc having the surface area thereof related to the pivot mounting whereby the disc will pivot to an open position when the pressure at the conduit side of the disc is greater than the pressure at the firebox side of the disc.

4. The fireplace structure of claim 1 wherein said means comprises automatically operable closure means associated with said conduit for closing said conduit when the fireplace is not in use or when combustion air is drawn through the front opening of the fireplace and for opening of the conduit when the fireplace is in use and said front opening is closed.

5. A fireplace structure as defined in claim 4 wherein said automatically operable closure means includes a pivoted damper which is pivotally mounted and carries a weight located above the pivot mounting when the damper is closed which assists in holding the damper closed and which acts to hold the damper open when the damper is open.

6. A fireplace structure having a firebox, a conduit having an air inlet external of said fireplace structure and an outlet positioned for delivery of combustion air to said firebox, and means including a movable member normally closing said conduit and openable in response to a pressure difference across said member caused by a fire in the firebox, and further including mechanism operable from the front of the fireplace for selectively engaging said movable member and holding the movable member against said stop regardless of said pressure difference.

7. A fireplace structure comprising:

a firebox;

door means for selectively closing a front opening to the firebox;

conduit means for delivering external air to the firebox for combustion; and automatically operable closure means associated with said conduit for closing said conduit when the fireplace is not in use or when combustion air is drawn in through the front opening of the fireplace and for opening of the conduit when the fireplace is in use and said front opening is closed, said automatically operable closure means including a pivoted damper which is pivotally mounted and carries a weight located above the pivot mounting when the damper is closed which assists in holding the damper closed and which acts to hold the damper open when the damper is open, and further including a rod rotationally mounted in said fireplace structure and having a part thereof adjacent said pivoted damper, and means operable from the front of the fireplace for rotating the rod between a first position wherein said rod part is positioned to avoid contact with the damper and a second position wherein said part engages and holds said damper closed.

8. A fireplace structure as defined in claim 7 wherein said conduit means has an outlet into a side of the firebox.

9. A fireplace structure comprising, a firebox having an outlet flue, door means for selectively closing a front opening to the firebox, conduit means for delivering external air to the firebox remotely of the flue for combustion, and automatically-operable closure means associated with said conduit and including a pivoted damper which is pivotally mounted and carries weight means located above the pivot mounting when the damper is closed for closing said conduit when the fireplace is not in use or when combustion air is drawn in through the front opening of the fireplace and for opening of the conduit when the fireplace is in use and said front opening is closed.

10. A fireplace structure as defined in claim 9 wherein said pivoted damper is mounted for pivoting about a horizonal axis, and a stop against which the damper abuts in closed position, said weight means on said damper being positioned to maintain the damper against the stop.

11. A fireplace structure as defined in claim 9 wherein said weight means includes a member secured to said damper and a plate secured to said damper in a position to limit opening movement of the damper.

12. A fireplace structure having a firebox having an outlet flue, a conduit for supplying combustion air to the firebox and having an air inlet external of the fireplace structure and an outlet positioned for delivery of combustion air to the firebox remotely of the flue, a damper positioned in said conduit adjacent said outlet and including a disc, a pivot mounting mounting the disc for pivotal movement about a generally horizontal axis, said disc having a major part thereof extending downwardly from the pivot mounting whereby the weight of the disc causes the disc to normally rest in a vertical conduit closing position and to have the surface areas of said major part responsive to a predetermined pressure difference at opposite sides thereof to cause movement of the disc from conduit closing position whereby the disc will open when the pressure at the conduit inlet side of the disc is greater than the pressure at the firebox side of the disc, and a stop member positioned to prevent pivoting of the disc to a conduit opening position when the greater pressure is at the firebox side of the disc.

* * * * *